US009512631B2

(12) United States Patent
Andon

(10) Patent No.: US 9,512,631 B2
(45) Date of Patent: Dec. 6, 2016

(54) TRAMPOLINE COVER

(71) Applicant: Vuly Pty Ltd., Wakerley (QLD) (AU)

(72) Inventor: Joe Andon, Wakerley (AU)

(73) Assignee: Vuly Pty Ltd., Wakerley (QLD) (AU)

( * ) Notice: Subject to any disclaimer, the term of this patent is extended or adjusted under 35 U.S.C. 154(b) by 0 days.

(21) Appl. No.: 14/385,591

(22) PCT Filed: Mar. 18, 2013

(86) PCT No.: PCT/AU2013/000264

§ 371 (c)(1),
(2) Date: Sep. 16, 2014

(87) PCT Pub. No.: WO2013/134831

PCT Pub. Date: Sep. 19, 2013

(65) Prior Publication Data

US 2015/0040959 A1 Feb. 12, 2015

(30) Foreign Application Priority Data

Mar. 16, 2012 (AU) ..... 2012901065

(51) Int. Cl.
*E04H 15/02* (2006.01)
*A63B 5/11* (2006.01)
*A63B 71/02* (2006.01)

(52) U.S. Cl.
CPC ..... *E04H 15/02* (2013.01); *A63B 5/11* (2013.01); *A63B 71/022* (2013.01)

(58) Field of Classification Search
CPC ..... E04H 15/04; E04H 15/64; E04H 15/36; A63B 5/00; A63B 5/11; A63B 2210/05; A63B 71/022; A63H 33/008
USPC ..... 135/96, 132, 133, 137, 161, 115, 116,135/119; 482/27–29; 5/93.1, 113, 121, 128, 414
See application file for complete search history.

(56) References Cited

U.S. PATENT DOCUMENTS

D187,138 S * 2/1960 Highberger ..... 482/27
4,819,680 A * 4/1989 Beavers ..... E04H 15/48 135/119
4,945,584 A * 8/1990 LaMantia ..... A47D 7/00 135/127
5,224,507 A * 7/1993 Vosse ..... E04H 15/58 135/115

(Continued)

FOREIGN PATENT DOCUMENTS

FR 2920998 A3 * 3/2009 ..... A63B 71/022

*Primary Examiner* — Winnie Yip
(74) *Attorney, Agent, or Firm* — Abelman, Frayne & Schwab

(57) ABSTRACT

A trampoline cover for a trampoline having a safety net supported by a plurality of support poles including: a frame assembly comprising a peripheral frame portion of substantially planar form mountable to the upper end of the support poles and one or more transverse members intersecting the peripheral frame member at opposed points to extend across the peripheral frame member spaced from the plane of the peripheral frame member; a flexible sheet detachably attached to the frame assembly; a plurality of pockets at or near the edge of the flexible sheet for engaging with end portions of at least some of the support poles whereby the flexible sheet may be supported above the support poles and frame assembly; and attachment means adjacent each pocket for attaching the flexible sheet to a respective one of the support poles.

8 Claims, 2 Drawing Sheets

(56) References Cited

U.S. PATENT DOCUMENTS

| | | | | | |
|---|---|---|---|---|---|
| 5,494,066 | A * | 2/1996 | McMahan | A47C 29/006 | 135/116 |
| 5,711,743 | A * | 1/1998 | Nichols, Jr. | A63B 5/11 | 135/133 |
| 6,053,845 | A * | 4/2000 | Publicover | A63B 5/11 | 482/27 |
| 6,058,528 | A * | 5/2000 | Yang | A47D 7/04 | 5/93.1 |
| 6,123,091 | A * | 9/2000 | Flynn | A47C 29/003 | 135/116 |
| 6,263,894 | B1 * | 7/2001 | LaMantia | A47C 29/006 | 135/117 |
| 6,934,981 | B2 * | 8/2005 | Waldman | A47D 7/007 | 5/11 |
| 7,854,687 | B2 * | 12/2010 | Alexander | A63B 5/11 | 482/27 |
| D664,228 | S * | 7/2012 | Hsiang | D21/797 | |
| 2007/0006910 | A1 * | 1/2007 | Chu | A47D 9/005 | 135/133 |
| 2008/0314427 | A1 * | 12/2008 | Lai | A63H 33/008 | 135/96 |
| 2011/0209736 | A1 | 9/2011 | Ball | | |
| 2012/0125389 | A1 | 5/2012 | Vaughn | | |

* cited by examiner

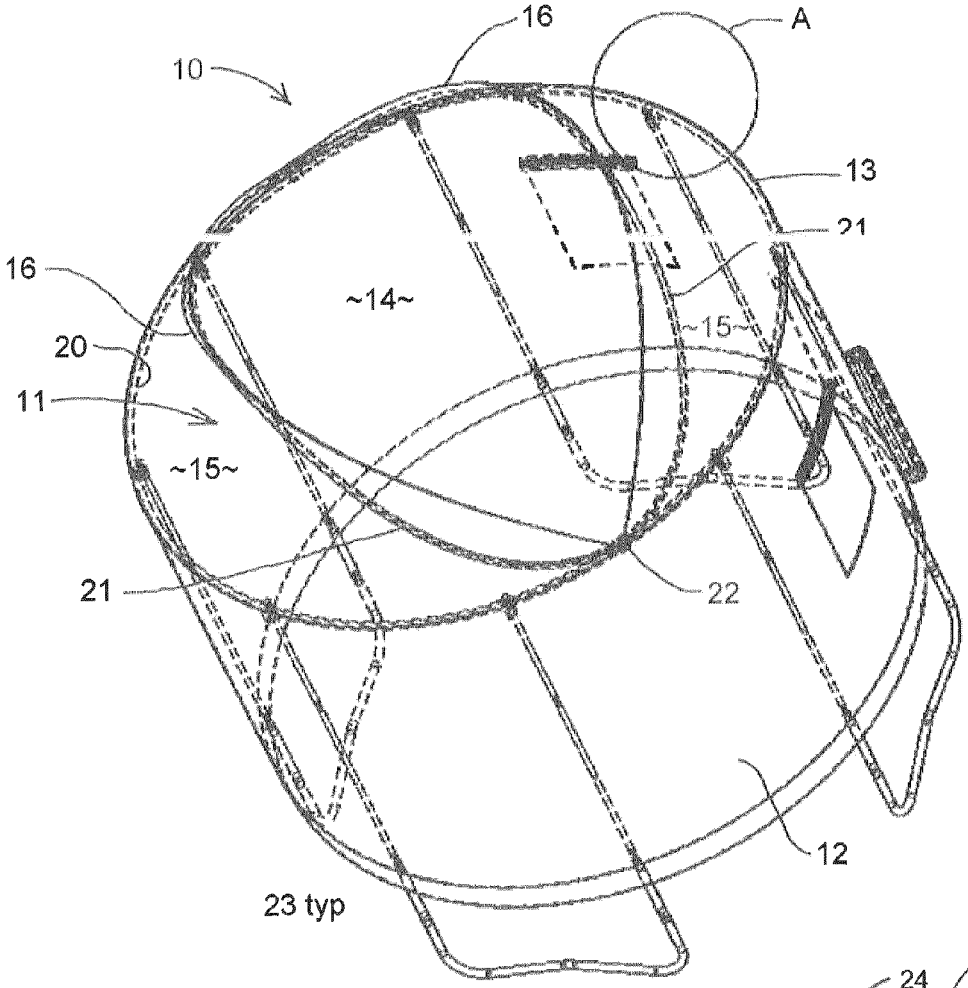
Fig. 1
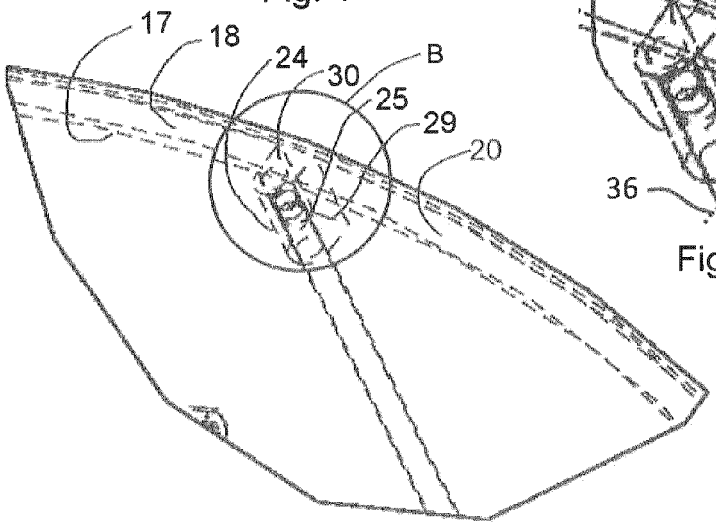
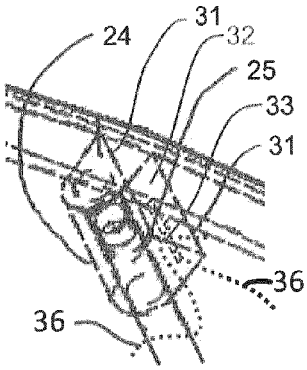
Fig. 2a
Fig. 2

TRAMPOLINE COVER

RELATED APPLICATIONS

This application is a National Stage Application of International Application PCT/AU2013/000264 filed Mar. 18, 2013 and claiming priority of Australian Application AU 2012 901065 filed Mar. 16, 2012. Both applications are incorporated herein by reference thereto.

BACKGROUND OF THE INVENTION

1. Field of the Invention

This invention relates to a trampoline cover. The invention has particular application to an improved canopy or cover for trampolines which have a safety net surrounding the trampoline mat, but the invention may have application to canopies generally as supported by tent-like poles to provide a free-standing structure.

2. Description of the Prior Art

Trampolines having a safety net surrounding the trampoline mat are preferred for safety reasons over trampolines without a safety net, and have been made available in the form of a trampoline mat resiliently supported by a surrounding frame and a plurality of poles extending upward from the surrounding frame to which a safety net is fastened, tied or otherwise attached. Trampolines are normally left outdoors, so covers have sometimes been provided. However, existing covers are often cumbersome and/or complicated to erect and disassemble. It is normally required that the safety net be at least partly detached from the poles in order for the cover to be mounted to or dismounted from the poles, and then for the safety net to be reattached One form of trampoline safety net is detachably attached to the poles by ties or straps each extending from the periphery of the net for tying or otherwise securing about an upper end portion of each pole.

The present invention is aimed at providing a trampoline cover which enables quick installation without the need to remove the safety net for installation and removal.

SUMMARY OF THE INVENTION

With the foregoing in view, the invention resides broadly in a trampoline cover for a trampoline having a safety net supported by a plurality of support poles including:

a frame assembly comprising a peripheral frame portion of substantially planar form mountable to the upper end of the support poles and one or more transverse members intersecting the peripheral frame member at opposed points to extend across the peripheral frame member such that at least part of each transverse member is spaced from the plane of the peripheral frame member;

a flexible sheet detachably attached to the frame assembly;

a plurality of pockets at or near the edge of the flexible sheet for engaging with end portions of at least some of the support poles whereby the flexible sheet may be supported above the support poles and frame assembly; and attachment means adjacent each pocket for attaching the flexible sheet to a respective one of the support poles.

In another aspect, the present invention resides broadly in a tent cover mountable to a plurality of upright support poles including:

a frame assembly supported by the support poles comprising a peripheral frame portion of substantially planar form and one or more transverse members intersecting the peripheral frame portion at opposed points to extend across the peripheral frame member spaced from the plane of the peripheral frame member;

a flexible sheet having attachment means for attaching the flexible sheet to the frame assembly; and a plurality of pockets at or near the edge of the flexible sheet for engaging with end portions of support poles for supporting the flexible sheet, together with the frame assembly above the support poles and frame assembly.

It will be appreciated that the tent cover according to the invention is equivalent to the trampoline cover hereinbefore described. Preferably, the flexible sheet is a sheet of textile having hemmed edge which provides a peripheral passage. Preferably, the flexible sheet comprises two or more gores in edge-to-edge abutting relationship. Preferably, the peripheral frame portion is one or more flexible peripheral frame members. More preferably, the peripheral frame portion is a single flexible frame member. In such form, the, frame member is formed to extend through the peripheral passage, but such that it may be removed therefrom.

Preferably, the or each transverse frame member is a flexible transverse frame member attachable to the peripheral frame member by each end at an attachment point. In such form, the transverse member or members have a length greater than the distance between the attachment points for each end whereby the transverse frame member or members span across the peripheral frame spaced from the plane of the peripheral frame member. It will be seen that the frame assembly is preferably of a form akin to that of a dome tent frame, and that the flexible sheet may have ties at predetermined locations to locate the transverse frame members at substantially evenly spaced dispositions across the dome of the cover. Preferably, however, a transverse passage is provided extending through the or each abutting edge of each gore and through which the transverse frame member or members may extend in order to keep the transverse frame member or members at the required location to provide the third dimension to the flexible sheet.

The trampoline cover may also have side walls extending from the peripheral edge and which depend downward therefrom when the trampoline cover is erected atop the support poles of the safety net. In such form, the side walls would typically be additional to the safety netting and provide, for example, for a weatherproof covering for the trampoline. Moreover, the peripheral frame member and transverse members may be of sufficient flexibility to permit folding the cover down with the fabric of the cover still in place, the peripheral frame member being twisted one or more times over to a figure eight configuration for storage of the cover when not installed on the top of the support poles of the trampoline.

BRIEF DESCRIPTION OF THE DRAWINGS

In order that the invention may be more readily understood and put into practice, reference will now be made to the accompanying drawings, wherein:

FIG. 1 is a diagrammatic pictorial view of a trampoline cover according to the invention;

FIG. 2 is a diagrammatic pictorial view of detail A of FIG. 1;

FIG. 2*a* is a diagrammatic pictorial view of detail B of FIG. 2; and

DETAILED DESCRIPTION OF THE PREFERRED EMBODIMENT

Figure 3:
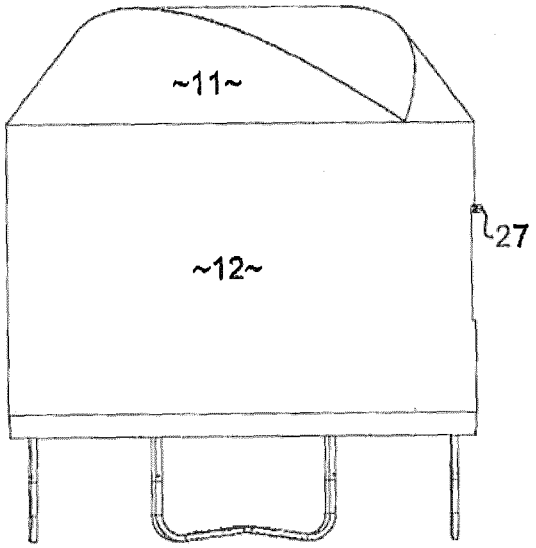
FIGS. 3, 4 and 5 constitute an orthographic projection of the trampoline cover of FIG. 1, being a front elevation, side elevation and plan view respectively.

The trampoline cover 10 illustrated in FIGS. 1 to 5 includes a cover sheet 11 of flexible textile material and a side wall panel 12 extending from the peripheral edge 13 of the cover sheet. The cover sheet is provided in three gores, a central gore 14 and two identical side gores 15 abutting the side edges of the central gore, the abutting edges being coincident with two transverse seams 16.

A peripheral frame member 20 extends in substantially circular form about the peripheral edge of the cover sheet through a passage formed by a hem along the peripheral edge of the cover sheet formed by a line of hem stitching 17 which stitched a hem fold 18 along the edge of the cover sheet, these elements being illustrated in FIGS. 1 and 2 in broken lines because they are hidden from view by the cover sheet and/or the wall panels. Two transverse frame members 21 extend across the peripheral frame member from diametrically opposed attachment points 22, each transverse frame member being substantially identically longer than the diameter of the circle of the peripheral frame member so that the transverse frame members arch upward above the plane of the circle of the peripheral frame member beneath the cover close to, but not coincident with the transverse seams.

The cover sheet is supported atop eight support poles shown typically at 23 which also support a safety net (not shown). The cover includes eight pockets, one of which is illustrated at 24 in the detail illustrated in FIG. 2, the pocket enclosing an upper portion 25 of the support pole. The pocket has a pocket wall 29 stitched or otherwise fastened to the hem fold and a pocket end wall 30 which is round at one end and squared off at the other end.

Each of the pockets is formed as a piece of material, an edge portion of which is sewn to the flexible sheet at 31 as shown in FIG. 2*a*, each pocket having a pocket wall 32 and each pocket wall having a side aperture 33 penetrating therethrough. In other words, the pocket has an opening through which the upper end of the support pole is receivable and a side aperture penetrating the pocket wall through which ties or straps 36 may be passed. In such form, the ties or straps may be temporarily undone, the pocket being placed over the end portion of the support pole, the tie or strap being reintroduced through the side aperture and tied off or otherwise secured to the pole. It will be seen that such an arrangement provides for the trampoline cover of the present invention to be securely fastened to the supporting poles, or, specifically, trampoline poles of a trampoline having a safety net surrounding a trampoline mat.

The trampoline cover of the present invention may be formed from textile material having qualities selected for the intended use, such as, but not limited to, being water and/or weatherproof, being open to provide for a breeze to penetrate or not as the case may be, transmitting of light or providing a block-out thereto, or to provide sun protection or protection from heat or cold. When used in conjunction with a trampoline having a safety net tied to support poles, the uppermost ties of the safety net may be temporarily undone and the pockets of the cover placed over the upper ends of the support poles. The uppermost ties may then be passed through the apertures in the pocket wall and retied to resecure the upper portion of the safety net as well as to tie down the trampoline cover. The trampoline cover may be removed from the trampoline by reversing the procedure.

Figure 4:
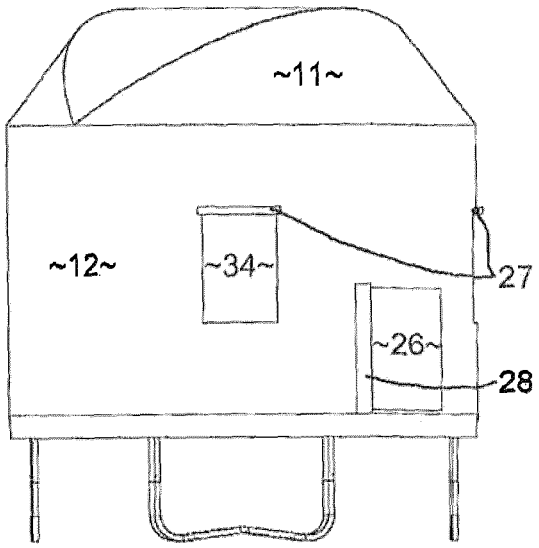
Figure 5:
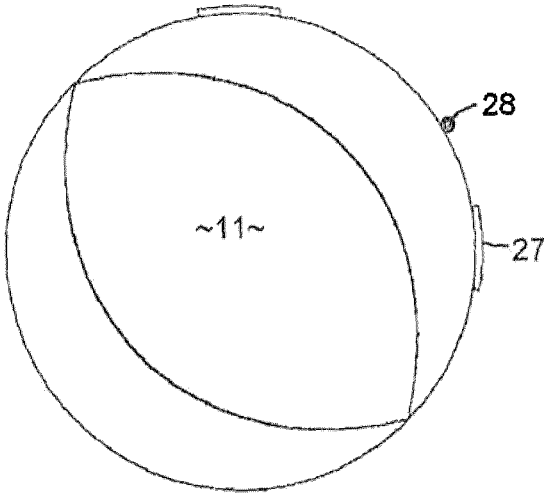

A typical application of the trampoline cover is illustrated in FIGS. 3 to 5. The side wall includes two window openings, one shown at 34 in FIG. 4 and a doorway 26. The window has a window cover which may be rolled up as illustrated at 27 and in a similar fashion, a doorway cover may be rolled up about a vertical axis as illustrated at 28. In one form, the peripheral and transverse frame members may be of a flexible type which permits them to be folded upon themselves in the form of a figure eight, or multiply looped in a similar fashion upon themselves, thereby reducing the storage volume of the trampoline cover.

The foregoing description has been given by way of illustrative example of the invention and any modifications and variations which will be apparent to persons skilled in the art may be made without departing from the spirit and scope of the invention as defined by the appended claims.

The claims defining the invention are as follows:

1. A trampoline cover for a trampoline having a safety net supported by a plurality of support poles each having an upper end and a lower end the trampoline cover comprising:

a frame assembly having a peripheral frame member of a substantially planar form for being dispositionally mounted to the upper end of the support poles and one or more transverse members intersecting the peripheral frame member at opposed points to extend across the peripheral frame member such that at least part of each transverse member is spaced from the plane of the peripheral frame member;

a flexible sheet having an edge, the flexible sheet being detachably attached to the frame assembly;

a plurality of pockets at or near the edge of the flexible sheet for engaging with end portions of at least some of the support poles whereby the flexible sheet is capable of being supported above the support poles and frame assembly, each of the pockets having a pocket wall and each pocket wall having a side aperture penetrating therethrough; and ties or straps passing through the side aperture for attaching the flexible sheet to a respective one of the support poles.

2. The trampoline cover according to claim 1, wherein the flexible sheet is a sheet of textile having a hemmed edge which provides a peripheral passage.

3. The trampoline cover according to claim 2, wherein the peripheral frame member is a flexible peripheral frame member extending through the peripheral passage.

4. The trampoline cover according to claim 3, having a plurality of transverse frame members, each transverse frame member is a flexible transverse frame member attachable to the peripheral frame member by each end at an attachment point, the transverse frame members having a length greater than a distance between the attachment points for each end whereby the transverse frame members span across the peripheral frame spaced from the plane of the peripheral frame member.

5. The trampoline cover according to claim 4, wherein a transverse passage is provided extending through each abutting edge of each gore and through which the transverse frame members may extend in order to keep the transverse frame members at the required location to provide the third dimension to the flexible sheet.

6. The trampoline cover according to claim 1, wherein the flexible sheet comprises two or more gores in edge-to-edge abutting relationship.

7. The trampoline cover according to claim 1 wherein the flexible sheet has side walls extending from a peripheral edge and which depend downward therefrom when the trampoline cover is erected atop the poles of the safety net of a trampoline.

8. A tent cover to be supported on a plurality of upright support poles, comprising:

a frame assembly for being supported by the upright support poles and having a peripheral frame member of substantially planar form defining a frame space and one or more transverse members intersecting the peripheral frame portion at opposed points to extend across the frame space of the peripheral frame member spaced from the plane of the peripheral frame member;

a flexible sheet having ties or straps for attaching the flexible sheet to the frame assembly; and a plurality of pockets at or near the edge of the flexible sheet for engaging with end portions of support poles for supporting the flexible sheet, together with the frame assembly above the support poles and frame assembly, each of the pockets having a pocket wall and each pocket wall having a side aperture penetrating therethrough, the ties or straps passing through the side apertures.

* * * * *